US006039661A

United States Patent [19]

Christian et al.

[11] Patent Number: 6,039,661

[45] Date of Patent: Mar. 21, 2000

[54] REINFORCED HOCKEY REPLACEMENT BLADE AND METHOD OF MAKING THE SAME

[75] Inventors: William D. Christian; Roger A. Christian, both of Warroad, Minn.

[73] Assignee: Christian Brothers, Inc., Warrod, Minn.

[21] Appl. No.: 08/906,599

[22] Filed: Aug. 6, 1997

[51] Int. Cl.[7] ..... A63B 59/14

[52] U.S. Cl. ..... 473/562; 473/561; 473/563

[58] Field of Search ..... 473/562, 563, 473/561, 560, FOR 189

[56] References Cited

U.S. PATENT DOCUMENTS 5,303,916 4/1994 Rodgers ..... 473/562

5,728,016 3/1998 Hsu ..... 473/563

FOREIGN PATENT DOCUMENTS 459578 9/1949 Canada ..... 473/FOR 189

2071022 12/1992 Canada ..... 473/FOR 189

2062635 9/1993 Canada ..... 473/FOR 189

*Primary Examiner*—Mark S. Graham

[57] ABSTRACT

A reinforced hockey replacement blade having a pair of reinforcement strips extending from the outermost end of the connection end past the point at which the replacement blade is connected with the handle and embedded within a recessed area of the replacement blade. The invention also relates to a method for making such a replacement blade.

15 Claims, 5 Drawing Sheets

REINFORCED HOCKEY REPLACEMENT BLADE AND METHOD OF MAKING THE SAME

BACKGROUND OF THE INVENTION

1. Field of the Invention

The present invention relates generally to the field of hockey sticks and the like, and more particularly, to a reinforced hockey replacement blade adapted for connection to and use with a hockey stick handle. The invention also relates to a method of making such a replacement blade.

2. Description of the Prior Art

Ice hockey sticks have experienced dramatic changes throughout the years. Specifically, ice hockey sticks have evolved from plain wooden sticks having a straight blade and handle to significantly improved sticks having a curved blade and fiberglass reinforcement.

The construction of the stick has also evolved substantially. Initially, the handle and blade portions were both constructed of wood and were integrally joined with one another through various processes so that the blade and the handle were essentially a single, integral unit. As technology developed, metal handles, particularly aluminum handles, were introduced and more recently, plastic or composite handles have also been introduced. Both aluminum and plastic or composite handles are elongated and generally hollow, and are secured to a replacement blade by a heat sensitive adhesive.

A typical replacement blade includes a blade portion, a shaft portion and a connection end. The blade portion includes a toe end and a heel end. The shaft portion begins at the heel and extends upwardly to the connection end. The connection end is designed and shaped for insertion into the lower end of the aluminum or plastic handle where it is retained by the heat sensitive adhesive. The blade and shaft portions of the replacement blade are commonly covered with a reinforcement material to improve the strength and durability of these areas. One reinforcement technique involves providing a sheet of fiberglass or other reinforcing material and folding or wrapping the sheet around the blade and shaft portions. Another reinforcement technique involves the use of a sleeve of braided fiberglass or other reinforcing fibers as shown in Canadian Patent No. 1,138,912 issued in 1983 to Harwell. In both cases, a curable resin is applied to the reinforcement material to bond such material to the replacement blade. After the resin cures, excess reinforcement material is removed by sanding and the shaft end of the replacement blade is cut or routed to form a shoulder and thus the connection end. During formation of the connection end, a portion of the wood and reinforcement material is removed to provide the connection end with the proper configuration and dimensions for insertion into the hollow end of the metal or plastic handle.

Although metal and plastic hockey stick handles with connected replacement blades function satisfactorily, and have been generally positively received by hockey players, there has been a tendency for the connection end of the replacement blade to break at or near the point at which the blade is secured at the lower end of the handle. This tendency to break is due in large measure to the necessary removal of the reinforcement material and a general narrowing of dimensions at the connection end to enable its insertion into the handle. The problem is further compounded by the continuing popularity of the slapshot and the emergence of bigger and stronger players, both of which result in greater stresses being placed on the hockey stick.

Experience has generally shown that the weakest point of a replacement blade is usually at the point at which the blade joins with the lower end of the handle.

This problem has been previously recognized and various attempts have been made to reinforce the replacement blade at the point of connection. For example, U.S. Pat. No. 3,934,875 issued to Easton et al., uses a tapered metal shank which mates with a rectangular tubular shaft or handle to form a bond between the handle and blade. In U.S. Pat. No. 4,358,113 issued to McKinnon et al., a double box beam shaft in which a pair of fiberglass rods are positioned to provide reinforcement through the heel and neck portions of the blade. Both of these solutions require a plastic or fabricated blade. Thus, they are not applicable to wooden blades.

A solution applicable to wooden blades is shown in U.S. Pat. No. 5,496,027 issued to Christian, et al. In this patent the fabric fiberglass or other reinforcement material is extended up over the hozel or connection end of the replacement blade and then a clamp or molding device is utilized to provide the final configuration to the connection end. Still other proposed solutions have simply involved securing reinforcement material in the form of reinforcement strips to the sides of the connection end so that the strips extend downwardly past the connection point and onto a side portion of the replacement blade. However, in this latter solution, the final sanding step results in much of the reinforcing material being removed as the material is sanded to make it substantially flush with the wood portion of the blade to which it is connected. The reduces the benefit of the reinforcement material. Further, this solution of ten merely results in a transfer of the weak point of the replacement blade from its connection point to some other location.

Accordingly, a need continues to exist in the art for a hockey replacement blade useable with an aluminum or plastic hockey stick handle in which the connection end as well as the remainder of the replacement blade is reinforced to minimize breakage in a cost effective and efficient manner.

SUMMARY OF THE INVENTION

The present invention relates to an improved, reinforced hockey stick and a method of making the same. More particularly, the present invention relates to a replacement blade for a hockey stick handle with improved reinforcement in the area between the hozel or connection end and between the hozel and the bottom edge of the blade.

More particularly, the replacement blade of the preferred embodiment comprises a blade which includes top and bottom edges, toe and heel ends and front and back sides and a shaft which is integrally connected with, and extends outwardly and upwardly from, the blade. The uppermost end of the shaft is provided with a hozel or a shaft connection end which is adapted for insertion into and connection with the hollow lower end of a hockey stick handle.

In the preferred embodiment of the present invention, the blade and shaft are constructed of wood and a recessed area is formed on each side of the shaft to receive an elongated reinforcement strip. This recessed area preferably extends from the uppermost end of the hozel all the way to the bottom edge of the blade at the heel end. The replacement blade further includes a shoulder in the front and back edges of the shaft portion to define the connection end. Secured within the recessed areas by appropriate adhesive are reinforcement strips which, in the preferred embodiment, extend from the free end of the connection end to the bottom edge of the blade. Thus, the reinforcement strips on each side of the replacement blade form the outer side surface of the connection end as well as the outer side surfaces of the shaft and a portion of the blade. The reinforcement strips have a thickness approximating the depth of the recessed areas. Thus, when the replacement blade is fine sanded or finished sanded, a minimum amount of reinforcement material is removed. If preferred, the blade and shaft portions can then be further wrapped or reinforced with woven or braided reinforcement fabric in a manner conventional in the art.

The method of making a replacement blade in accordance with the present invention involves first forming a rough cut and rough sanded replacement blade from woodstock in a conventional manner. A recessed area is then formed in each side of the rough cut replacement blade with a router, a milling device or some other cutting means. In the preferred embodiment, these recessed areas are formed on the sides of the shaft and blade portions and extend from the uppermost end of the shaft portion to the bottom edge of the blade at the heel end. An elongated reinforcement strip of relatively stiff plastic such as unidirectional fiberglass is then applied in the recessed area and secured thereto by an appropriate adhesive. After finish or fine sanding and further reinforcement with fiberglass fabric or the like in a manner known in the art, shoulder portions are then formed in the front and back edges of the upper end of the shaft portion to define the connection end.

Accordingly, it is an object of the present invention to provide an improved, reinforced hockey stick having a stick handle and a reinforced replacement blade. The replacement blade includes a blade portion, a shaft portion and a reinforced connection end.

Another object of the present invention is to provide a replacement blade for a hockey stick handle which is reinforced by reinforcement strips in recessed areas on the sides of the shaft and blade to limit breakage at the point of connection with the handle and throughout the replacement blade.

A further object of the present invention is to provide a replacement blade for a hockey stick having a connection end which is reinforced by a reinforcement strip in a recessed area extending from the free end of the connection end to the bottom edge of the blade and forms both the outer surface of the connection end and the outer surface of the shaft.

A still further object of the present invention is to provide a method of making a replacement blade of the type described above.

These and other objects of the present invention will become apparent with reference to the drawings, the description of the preferred embodiment and method, and the appended claims.

DESCRIPTION OF THE PREFERRED EMBODIMENT AND METHOD

Figure 1:
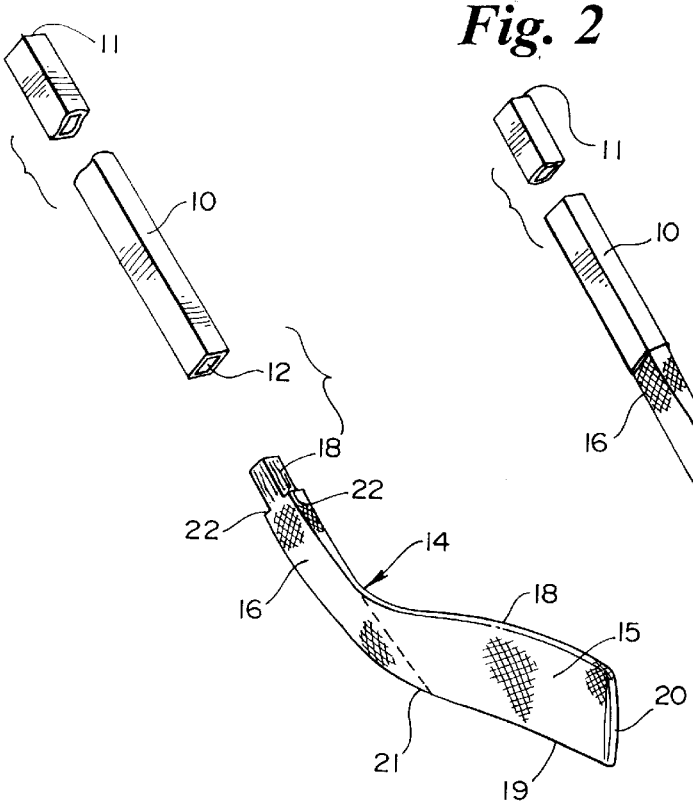
FIG. 1 is an exploded isometric view of a hockey stick incorporating the reinforced replacement blade of the present invention.
Figure 2:
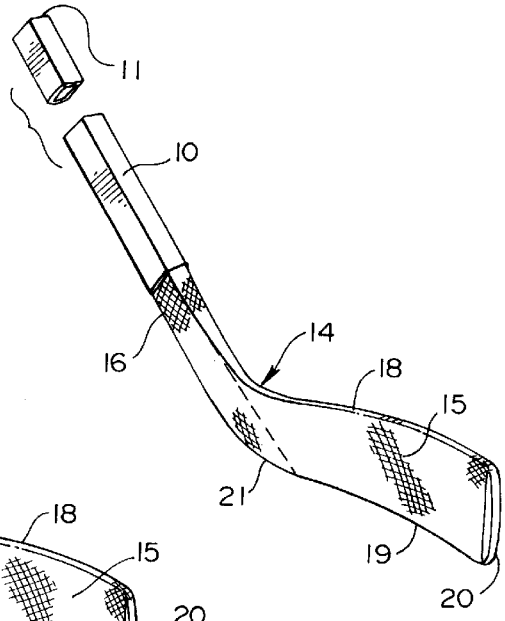
FIG. 2 is an isometric view of a hockey stick similar to FIG. 1 in which the replacement blade has been connected to the hockey stick handle.

The hockey replacement blade of the present invention has particular applicability for use with an aluminum, plastic or composite handle. When fully assembled and used, the present invention also relates to a hockey stick with an attached replacement blade in which the blade is provided with improved reinforcement to prevent breakage at the point where the replacement blade is connected with the hockey stick handle as well as throughout a major portion of the replacement blade. As shown in FIGS. 1 and 2, the hockey stick of the present invention includes an elongated handle 10 having a lower or blade connecting end 12 and an upper or free end 11. The handle 10 is preferably hollow throughout its entire length; however, in some embodiments, a portion of the handle 10 can be filled with a lightweight foam or other material to provide desired flex or stiffness characteristics to the handle. At least the lower end 12 of the handle 10 is hollow and is adapted to receive the connection end of a replacement blade. The handle 10 is commonly constructed of a light weight metal such as aluminum or a plastic or composite material.

The replacement blade 14 of the present invention includes a blade or blade portion 15, a shaft or shaft portion 16 and a connection end 18. The blade portion 15 includes top and bottom edges 18 and 19, a toe end 20 and a heel end 21. A pair of blade sides extend between the top and bottom edges 18 and 19 from the toe end 20 to the heel end 21 on each side of the blade 15 and are commonly referred to as the front and back or forehand and backhand sides of the blade. The shaft portion 16 is integrally connected with the blade portion 15 and extends upwardly and outwardly from the heel end 21. The uppermost end of the shaft 16 has a generally rectangular cross-sectional configuration defined by a pair of side surfaces and front and back edges. As will be described in greater detail below, the sides surfaces of the shaft 16 taper inwardly as they join the front and back sides of the blade 15 and the front and back edges of the shaft 16 curve as they extend downwardly to join the top and bottom edges 18 and 19, respectively, of the blade 15.

The outer or uppermost end of the shaft 16 is provided with a connection end or hozel 18 which is adapted for insertion into, and connection with, the lower end 12 of the handle 10. The connection end 18 has a generally rectangular configuration substantially confirming in size and configuration to the interior size and configuration of the end 12 to permit the end 18 to be inserted into the end of the handle in a tight fitting relationship. As is common in the art, the connection end 18 is provided with a heat sensitive adhesive to assist in securing the connection end 18, and thus the replacement blade 14, to the handle 10. As shown best in FIG. 1, the hozel or connection end 18 is defined by and separated from the shaft portion 16 by shoulders 22,22 formed in the front and back edges of the shaft portion 16. The shoulders 22,22 limit the distance which the hozel 18 can be inserted into the lower end 12 of the handle 10.

FIGS. 1 and 2 disclose the general structure of the replacement blade of the present invention. FIGS. 3–9 together with their related sectional and elevational figures disclose the method of making the replacement blade in accordance with the present invention and illustrate the structural elements of the replacement blade in further detail.

Figure 3:
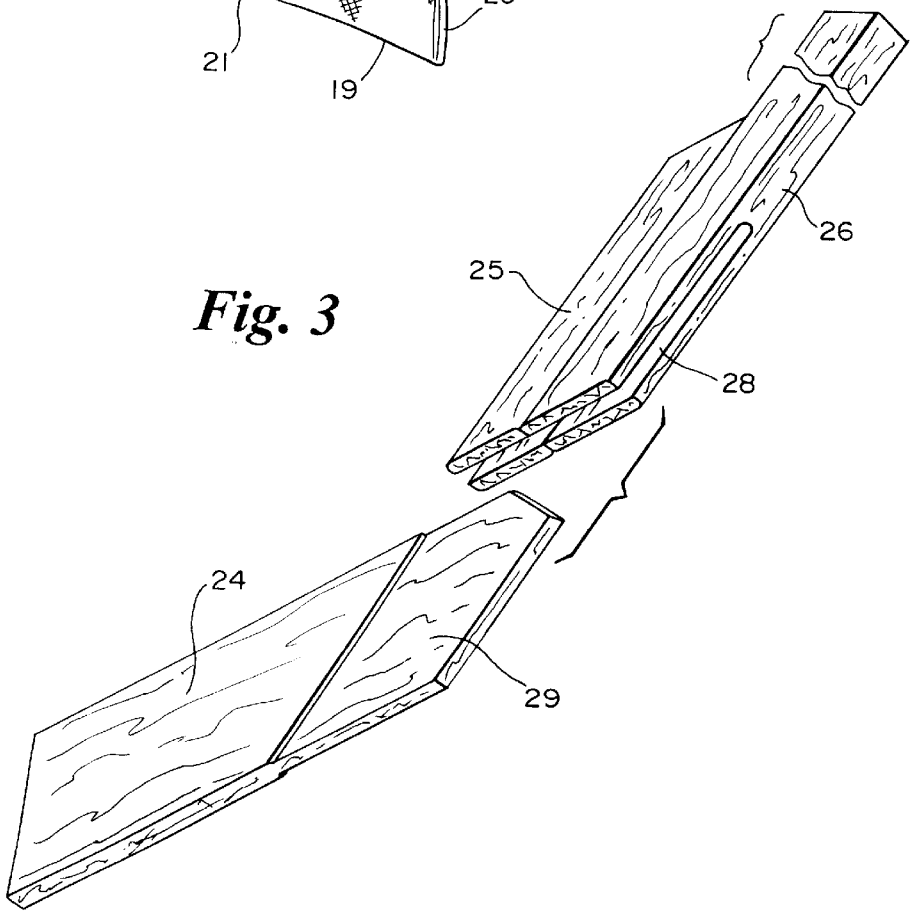
FIG. 3 is an exploded isometric view showing initial woodstock pieces in the manufacture of the replacement blade of the present invention.
Figure 4:
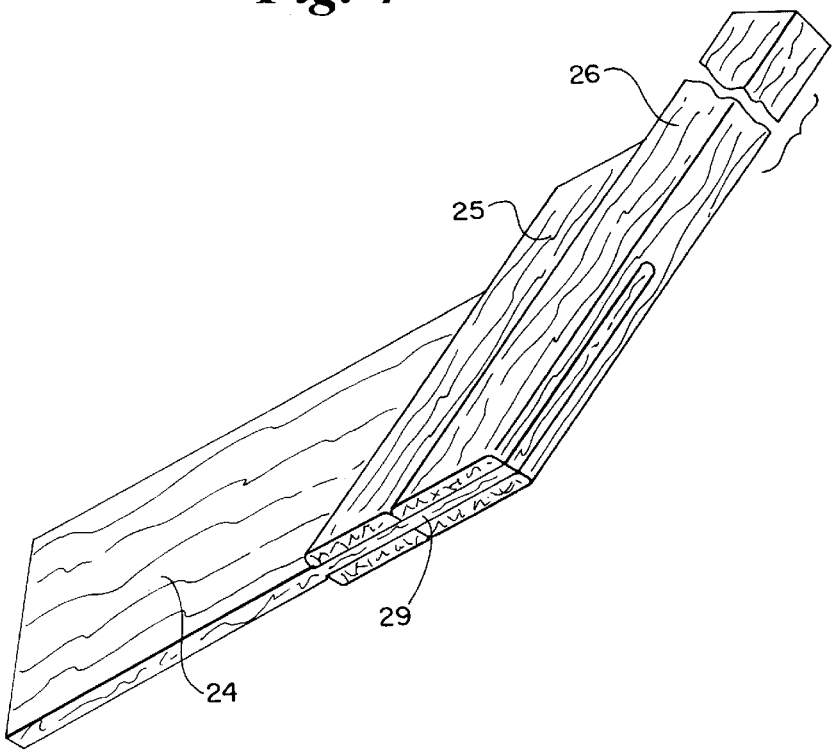
FIG. 4 is an isometric view similar to that of FIG. 3 with the woodstock pieces connected with one another.
Figure 5:
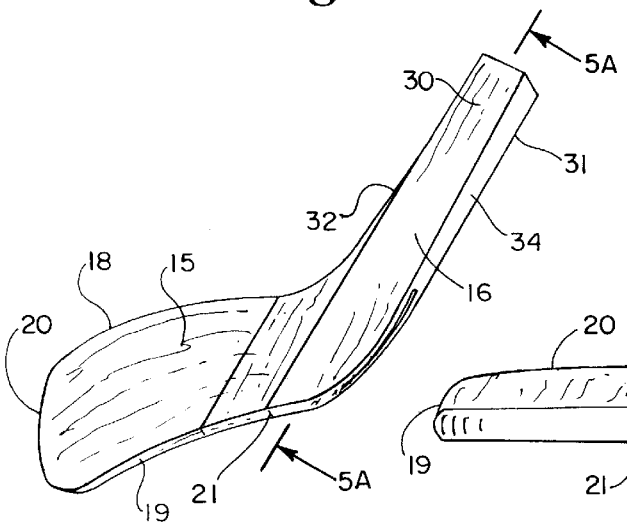
FIG. 5 is an isometric view of a rough cut and sanded replacement blade.

The first step in the method of making the replacement blade in accordance with the present invention is to prepare a rough cut replacement blade such as that illustrated in FIG. 5. Various processes are known in the art for making such a structure. Any one of these can be utilized in making the replacement blade of the present invention. The preferred method in accordance with the present invention is to provide various woodstock pieces in the form of a wooden bladestock 24, a wooden block 25 and a wooden shaftstock 26 as shown in FIG. 3. The block 25 and the shaftstock 26 are formed from conventional handle stock, are glued together along adjacent edges and are provided with a generally tapered slot or mortise 28 as shown. The bladestock 24 is a generally flat, planar piece of wood which is provided with a tongue area or tenon 29 of reduced thickness for insertion into the slot 28 where it is retained by an appropriate adhesive. The assembly and gluing of the pieces 24, 25 and 26 result in the rough blade configuration as illustrated in FIG. 4.

Figure 5A:
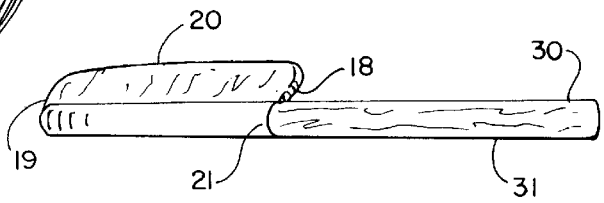
FIG. 5A is a view partially in section as viewed along the section line 5A—5A of FIG. 5.

The next steps in the process are to cut and shape the rough blade configuration of FIG. 4 on a profiler, to rough sand the blade and shaft and to provide the blade with the desired curve. This results in the rough cut replacement blade illustrated in FIGS. 5 and 5A. The rough cut replacement blade comprises the blade portion 15 and the shaft portion 16. The blade portion 15 includes top and bottom edges 18 and 19, toe and heel ends 20 and 21 and side surfaces 13 and 17. The shaft portion 16 extends upwardly from the blade 15 and has a generally rectangular configuration at its upper end defined by a pair of side surfaces 30 and 31 and front and back edges 32 and 34, respectively. As shown in both FIGS. 5 and 5A, the side surfaces 30 and 31 taper inwardly as they join with the side surfaces 13 and 17 of the blade portion 15. The front and back edges 32 and 34 curve as they join with the top and bottom edges 18 and 19, respectively, of the blade 15.

Figure 6:
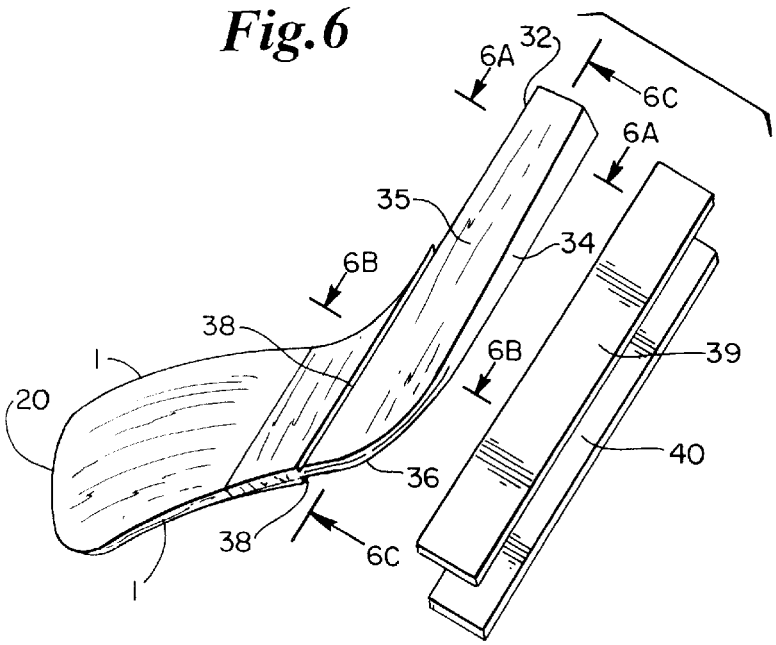
FIG. 6 is an exploded isometric view showing a further step in the manufacture of the replacement blade in accordance with the present invention.
Figure 6A:
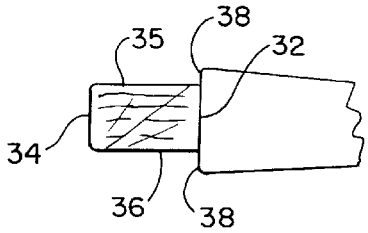
FIG. 6A is view partially in section as viewed along the section line 6A—6A of FIG. 6.
Figure 6B:
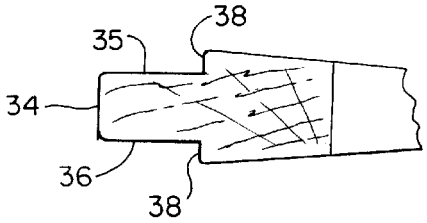
FIG. 6B is a view partially in section as viewed along the section line 6B—6B of FIG. 6.
Figure 6C:
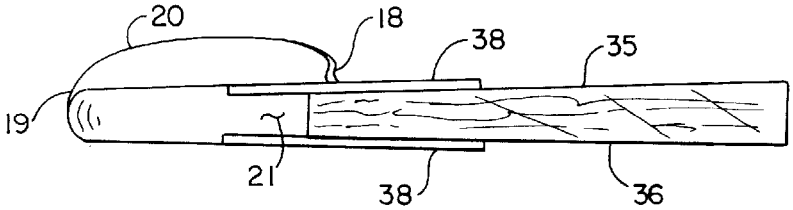
FIG. 6C is a view partially in section as viewed along the section line 6C—6C of FIG. 6.
Figure 7:
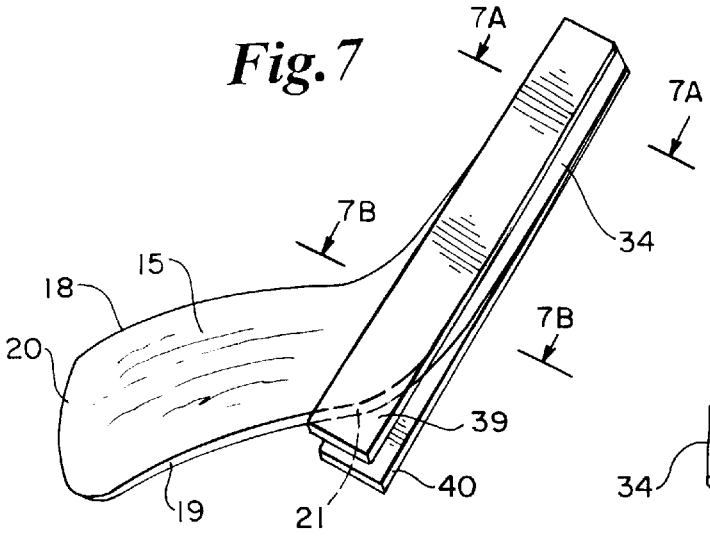
FIG. 7 is an isometric view showing a further step in the manufacture of the replacement blade in accordance with the present invention.
Figure 7A:
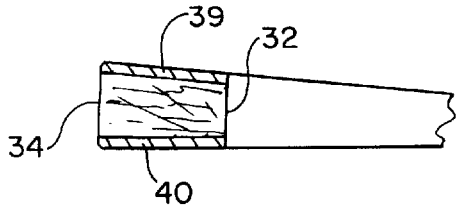
FIG. 7A is a view partially in section as viewed along the section line 7A—7A of FIG. 7.
Figure 7B:
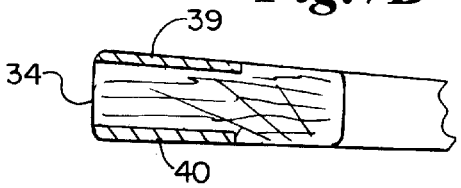
FIG. 7B is a view partially in section as viewed along the section line 7B—7B of FIG. 7.
Figure 8:
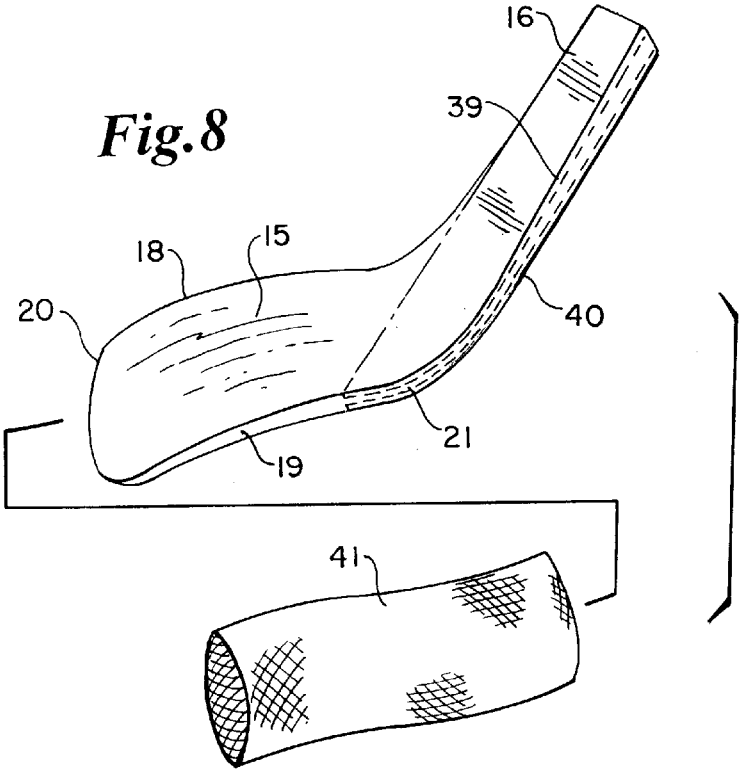
FIG. 8 is an exploded isometric view of a replacement blade in accordance with the present invention after being finish sanded and showing the application of fabric reinforcement to the outside of the replacement blade.

The next step in accordance with the method of the present invention is to provide the rough cut blade of FIG. 5 with recessed areas or reinforcement strip receiving areas 35 and 36 as shown in FIGS. 6, 6A, 6B and 6C. These recessed areas 35 and 36 are milled out with an appropriate milling or cutting tool and are positioned on each side of the rough cut replacement blade. In the preferred embodiment, the recessed areas 35 and 36 extend from the outermost end of the shaft portion 16 to the bottom edge 19 of the blade 15. As shown best in FIGS. 6 and 6A, the recessed areas 35 and 36 at the upper end of the shaft portion 16 extend over the entire side surfaces 30 and 31 of the shaft 16. As the recessed areas 35 and 36 approach the blade portion, they are defined by a straight-lined shoulder 38 on each side of the blade. As further shown in FIGS. 6 and 6A, the shoulders 38 are generally in line with the front edge 32 of the shaft portion 16. As shown in FIG. 6C, the recessed areas 35 and 36 follow the contour of the shaft sides 30 and 31 and their transition with the blade sides 13 and 17. Thus, the recessed areas 35 and 36 taper inwardly as they approach the bottom edge 19 of the blade portion 15. After the recessed areas 35 and 36 have been milled or cut as shown in FIG. 6, a pair of elongated reinforcement strips 39 and 40 are positioned within the recessed areas and secured thereto by an appropriate adhesive as shown in FIGS. 7, 7A and 7B. Preferably the thickness dimension of the reinforcing strips 39 and 40 approximates the depth dimension of the recessed areas 35 and 36 so that when the strips 39 and 40 are applied and positioned within the areas 35 and 36, their outer surfaces are substantially flush with the sides 13 and 17 of the blade adjacent to the shoulders 38. In the preferred embodiment, these strips 39 and 40 have a thickness of about 0.5 to 2.0 mills and most preferably a thickness of about 1.0 mill. It is also preferable that the reinforcing strips 39 and 40 have a width dimension which approximates the width of the sides 30 and 31 near the upper end of the shaft 16 so that the edges of the strips 39 and 40, when applied, are substantially flush with the front and back edges 32 and 34 of the shaft 16. The length dimension of the strips 39 and 40 in the preferred embodiment should be sufficient by long to extend from the uppermost end of the shaft 16 to the intersection between the shoulders 38 and the bottom edge 19 of the blade 15.

It is contemplated that a variety of different types of material may be utilized for the reinforcing strips 39 and 40; however, such material should be sufficiently strong to provide increased reinforcement strength to the replacement blade. In particular, it should exhibit sufficient reinforcement strength to minimize breakage not only at the point of connection with the handle, but also at points continuously along the strip from the top end of the shaft portion to the bottom edge 19 of the blade. In the preferred embodiment, the reinforcement strips 39 and 40 are constructed from fiberglass, most preferably from unidirectional fiberglass.

The next step in the process is to smooth sand or finish sand the replacement blade to provide desired radius or curvature to the edges and to provide the final finished shape of the replacement blade. It should be noted that during this finish sanding step, a minimal amount of the reinforcement strips 39 and 40 is removed since they are positioned within the recessed areas 35 and 36 which have depths approximating the thickness of the strips 39 and 40. Following this step, the replacement blade can, if desired, be provided with further fabric reinforcement over the exterior surface of the blade 15 and a portion of the shaft 16. This is done by processes known in the art by utilizing a tubular braid such as that shown by reference character 41 of FIG. 8 or sheets or wrappings of fiberglass or other reinforcement material. Following the application of fiberglass or other reinforcement fabric, the blade is again smooth sanded to remove excess portions of the reinforcement fabric and dipped in varnish.

Figure 9:
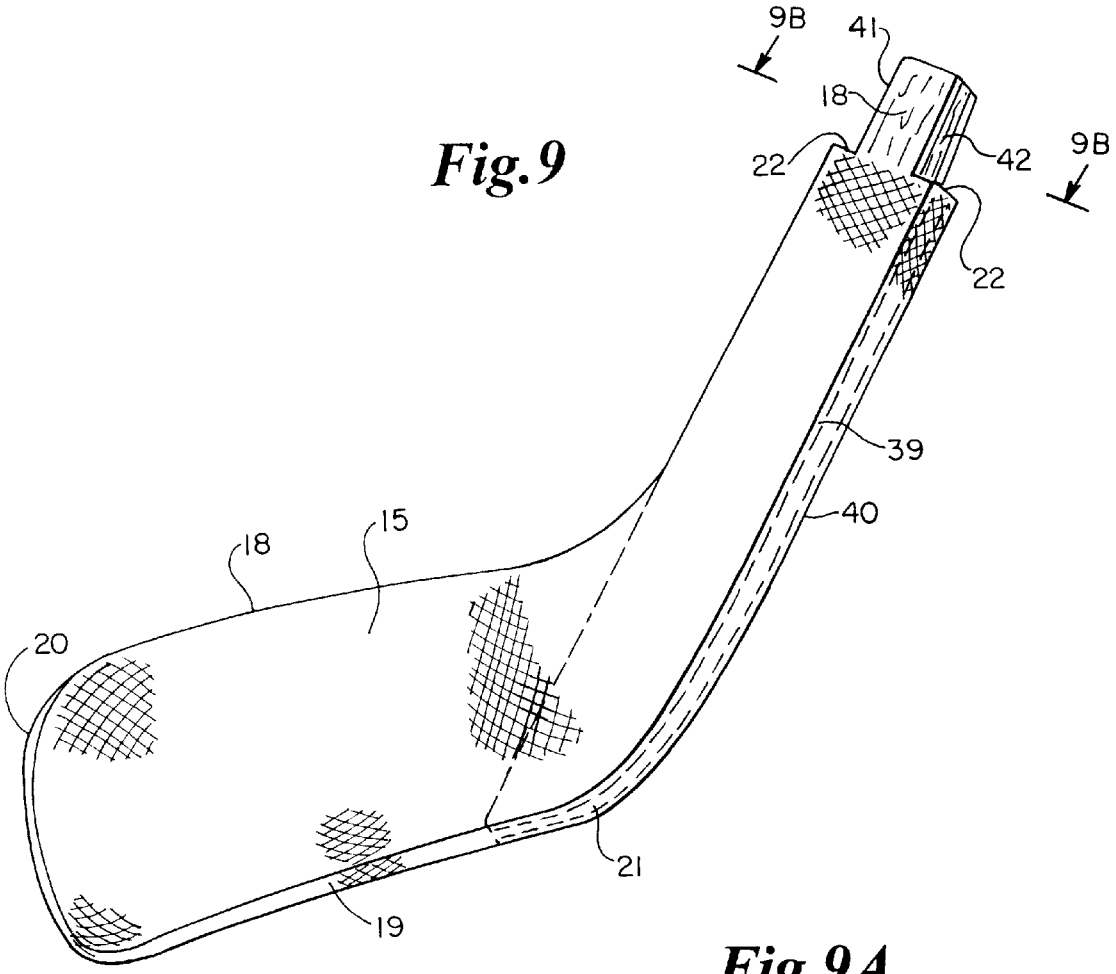
FIG. 9 is an isometric view of the finished replacement blade of the present invention.
Figure 9A:
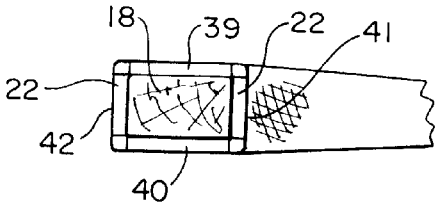
FIG. 9A is an elevational top view of the connection end of the finished replacement blade of FIG. 9.
Figure 9B:
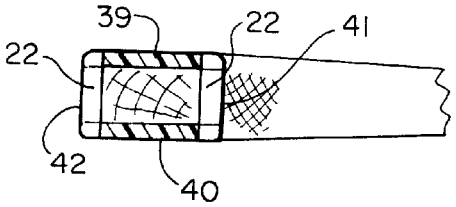
FIG. 9B is a view partially in section as viewed along the section line 9B—9B of FIG. 9.

The final step in the process is to cut the front and back edges 32 and 34 of the outermost end of the shaft 16 to define the hozel or connection end 18 as shown in FIG. 9. The connection end 18 is defined by shoulders 22,22 to limit the distance which the replacement blade can be inserted into the lower end 12 of the handle 10 (FIG. 1) and includes front and back edges 41 and 42 and side surfaces defined by the outer surfaces of the strips 30 and 40. Accordingly, when finished, the side surfaces of the connection end 18 are continuous with the side surfaces of the shaft 16, both of which are formed by the outer surfaces of the reinforcement strips 39 and 40. Preferably, the strips 39 and 40 extend to the bottom edge 19. The finished replacement blade as shown in FIG. 9 includes shoulders 22,22 on the front and back edges of the connection end 18, but is characterized by the absence of shoulders on its side 30 and 31.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A substantially wooden replacement blade adapted for insertion into the lower end of a hockey stick handle, said replacement blade comprising:

a blade portion having top and bottom edges, a pair of blade sides and toe and heel ends;

a shaft portion having a lower end extending from said blade portion, an upper end forming a connection end for insertion into a hollow lower end of a hockey stick handle, a front edge joining with the top edge of said blade portion, a back edge joining with the bottom edge of said blade portion and a pair of shaft sides extending between said front and back edges, said connection end having a free end comprising an uppermost end of shaft portion and a connection end shoulder in at least one of said front and back edges;

a reinforcement strip receiving area and a corresponding reinforcement strip shoulder on each of said pair of shaft sides, each of said reinforcement strip areas extending from said free end, past said connection end shoulder and toward said lower end of said shaft portion and extending from said back edge to its corresponding reinforcement strip shoulder, one of said reinforcement strip shoulders extending between its corresponding reinforcement strip receiving area and one of said blade sides and the other of said reinforcement strip shoulders extending between its corresponding reinforcement strip receiving area and the other of said blade sides;

a reinforcement strip secured to each shaft side in said reinforcement strip receiving area so that each of said reinforcement strips extends from said free end, past said connection end shoulder and toward said lower end of said shaft portion, with an edge of one of said reinforcement strips adjacent to one of said reinforcement strip shoulders and an edge of the other of said reinforcement strips adjacent to the other of said reinforcement strip shoulders.

2. The replacement blade of claim 1 wherein said reinforcement strip receiving areas extend from said free end to said bottom edge of said blade.

3. The replacement blade of claim 2 wherein said reinforcement strip receiving areas converge toward one another as they approach said bottom edge of said blade.

4. The replacement blade of claim 1 wherein said reinforcement strip includes a thickness dimension and wherein the depth of said strip receiving area adjacent to said reinforcement strip shoulder approximates said thickness dimension.

5. The replacement blade of claim 4 wherein each of said reinforcement strip receiving areas extends from said free end to said bottom edge of said blade.

6. The replacement blade of claim 4 wherein each of said reinforcement strip receiving shoulders is generally in line with said front edge.

7. The replacement blade of claim 6 wherein each of said reinforcement strip receiving areas extends from said free end to said bottom edge of said blade.

8. The replacement blade of claim 1 including a fabric reinforcement covering said blade and shaft portions.

9. The replacement blade of claim 1 connected with a hockey stick handle.

10. The replacement blade of claim 4 wherein said reinforcement strip receiving areas extend from said free end to said bottom edge of said blade.

11. The replacement blade of claim 10 wherein said reinforcement strip receiving areas converge toward one another as they approach said bottom edge of said blade.

12. The replacement blade of claim 11 wherein each of said reinforcement strip receiving shoulders is generally in line with said front edge.

13. The replacement blade of claim 12 including a fabric reinforcement covering said blade and shaft portions.

14. The replacement blade of claim 1 wherein each of said reinforcement strips includes a reinforcement strip shoulder in a position corresponding to said connection end shoulder.

15. The replacement blade of claim 1 wherein the thickness of said reinforcement strip is substantially uniform throughout its entire length.

* * * * *